US009848477B2

(12) United States Patent
Cai et al.

(10) Patent No.: US 9,848,477 B2
(45) Date of Patent: Dec. 19, 2017

(54) METHOD FOR CONTROLLING TIME SHARING STARTING OF ELECTRONIC BALLASTS AND DELAYED-STARTED ELECTRONIC BALLAST

(71) Applicant: SHENZHEN TECHONE TECH CO., LTD., Shenzhen, Guangdong (CN)

(72) Inventors: Shixue Cai, Guangdong (CN); Zhongwei Jiang, Guangdong (CN)

(73) Assignee: SHENZHEN TECHONE TECH CO., LTD., Shenzhen (CN)

( * ) Notice: Subject to any disclaimer, the term of this patent is extended or adjusted under 35 U.S.C. 154(b) by 178 days.

(21) Appl. No.: 14/413,472

(22) PCT Filed: Mar. 12, 2014

(86) PCT No.: PCT/CN2014/073284

§ 371 (c)(1),
(2) Date: Jan. 8, 2015

(87) PCT Pub. No.: WO2014/198139

PCT Pub. Date: Dec. 18, 2014

(65) Prior Publication Data

US 2016/0088713 A1 Mar. 24, 2016

(30) Foreign Application Priority Data

Jun. 14, 2013 (CN) ..... 2013 1 0233968

(51) Int. Cl.
*H05B 37/02* (2006.01)
*H05B 41/282* (2006.01)
*H05B 41/285* (2006.01)

(52) U.S. Cl.
CPC ..... *H05B 37/0227* (2013.01); *H05B 37/0245* (2013.01); *H05B 41/282* (2013.01); *H05B 41/2851* (2013.01)

(58) Field of Classification Search
CPC ..... H05B 37/0227; H05B 37/0245; H05B 41/282; H05B 41/2851
See application file for complete search history.

(56) References Cited

U.S. PATENT DOCUMENTS

2002/0133789 A1* 9/2002 Hsu ..... G06F 1/206 716/136
2007/0103100 A1* 5/2007 Yufuku ..... H05B 37/03 315/360

(Continued)

FOREIGN PATENT DOCUMENTS

CN 1780521 A 5/2006
CN 101896857 A 11/2010

(Continued)

OTHER PUBLICATIONS

International Searching Authority (ISA), International Search Report (ISR) and Written Opinion for International Application No. PCT/CN2014/073284, dated Jun. 17, 2014, 10 pages., State Intellectual Property Office of the P.R.C.

(Continued)

*Primary Examiner* — Jared Fureman
*Assistant Examiner* — Emmanuel R Dominique

(57) ABSTRACT

The invention discloses a method for controlling the time sharing starting of electronic ballasts and a delayed-started electronic ballast. According to the method, the electronic ballasts are delayed-started after being energized, and delay time for the delayed starting of the electronic ballasts is a random number acquired based on the temperature of the ballasts. The delayed-started electronic ballast includes an electronic ballast body and a delay switch. After the adoption of the technical scheme of the invention, a delayer with the delay time set by virtue of random numbers corresponding to different environmental temperature is additionally arranged in the ballast, and multiple ballasts connected in (Continued)

parallel in a circuit can be started at different time points after different delay time under the control of the same control switch, which remarkably reduces current impact on a power grid and reduces a voltage drop condition.

3 Claims, 1 Drawing Sheet

(56) References Cited

U.S. PATENT DOCUMENTS

| | | | | |
|---|---|---|---|---|
| 2008/0179498 | A1* | 7/2008 | Shimizu ..... | H05B 33/0818<br>250/214 AL |
| 2013/0221867 | A1* | 8/2013 | Deppe ..... | H05B 33/0809<br>315/224 |

FOREIGN PATENT DOCUMENTS

| | | | |
|---|---|---|---|
| CN | 202231933 | U | 5/2012 |
| CN | 103298225 | A | 9/2013 |
| CN | 203352923 | U | 12/2013 |

OTHER PUBLICATIONS

The International Bureau of WIPO, International Preliminary Report on Patentability (English Translation of ISA's Written Opinion) for International Application No. PCT/CN2014/073284, dated Dec. 23, 2015, 9 pages, Switzerland.

* cited by examiner

METHOD FOR CONTROLLING TIME SHARING STARTING OF ELECTRONIC BALLASTS AND DELAYED-STARTED ELECTRONIC BALLAST

FIELD OF THE INVENTION

The invention relates to an electronic ballast, in particular to a method for starting electronic ballasts in a time sharing way in order to overcome the short-term voltage drop of a line when multiple electronic ballasts work in parallel and a delayed-started electronic ballast.

BACKGROUND OF THE INVENTION

Most of gas discharge lamps are manufactured by virtue of an arc discharge characteristic, have a negative characteristic (also called a negative resistance characteristic) that voltage drops along with the increase of current, and cannot establish a stable working point. In order to stabilize discharge and limit the working current of the lamp, it is necessary to arrange a ballast in a gas discharge light source circuit. The ballast has become an important additional device for the gas discharge light source circuit. The ballast is an electronic control device for converting direct current or low-frequency alternating current voltage into high-frequency alternating current voltage to drive a light source such as a low-voltage gas discharge lamp and a tungsten halogen lamp to work. At present, an electronic ballast for a fluorescent lamp is the most widely used.

The electronic ballast is widely used by virtue of its multiple advantages such as low energy consumption, high efficiency, high luminous efficiency, light weight and high power factor. Particularly, the advantages of a high-power electronic ballast during application are more obviously presented. Therefore, multiple ballasts are connected in parallel for concentrated use in a vegetable planting place, a streetlamp and the like. During application, when a line is energized by a switch in a unified way, each electronic ballast is simultaneously started to work. Under the existence of line impedance in a power grid, heavy current generated by the simultaneous starting of multiple electronic ballasts causes the voltage drop of the line, and in order to maintain starting power, it is necessary to multiply the input current of the electronic ballasts which are constant power loads, which further causes the voltage drop of the power grid and the formation of a vicious circle. It is manifested as the short-term voltage drop of the line. When an actual condition is serious, for example, the line impedance is high and a great number of electronic ballasts are connected in parallel, a certain electronic ballast will be damaged. According to statistics, more than 40 percent of electronic ballasts are damaged when being started.

SUMMARY OF THE INVENTION

In order to solve the technical problem that electronic ballasts are randomly damaged by the instantaneous voltage drop of a power grid caused by the simultaneous starting of multiple electronic ballasts and lamp tubes, which are connected in parallel, the invention provides a method for controlling the time sharing starting of electronic ballasts and a delayed-started electronic ballast.

A technical scheme of the invention is that: a method for controlling the time sharing starting of electronic ballasts, the electronic ballasts being delayed-started after being energized, and acquiring delay time for the delayed-starting of the electronic ballasts including the following steps:

A: detecting the real-time temperature of the electronic ballasts;

B: performing normalization processing on real-time temperature values of the electronic ballasts at this moment; and C: acquiring the delay time mapped after the normalization of the real-time temperature values from a predetermined mapping relationship between each value in a normalization interval and the delay time.

Furthermore, in the method for controlling the time sharing starting of the electronic ballasts: performing the normalization processing on the real-time temperature in Step B includes the following steps:

B01: amplifying the real-time temperature values; and

B02: intercepting low-order digit parts of the amplified real-time temperature values.

Furthermore, in the method for controlling the time sharing starting of the electronic ballasts: in Step B01, the real-time temperature values are amplified to at least hundreds, and decimal parts are discarded; units digits and tens digits of the amplified real-time temperature values are intercepted in Step B02; and the method further includes a Step B03 of dividing results obtained in Step B02 by 2 and rounding quotients to obtain normalized values.

Furthermore, in the method for controlling the time-sharing starting of the electronic ballasts: the predetermined mapping relationship between each value in the normalization interval and the delay time is: the normalized values 0 to 49 are mapped to the delay time of 0.1 to 5.0 seconds.

The invention also provides a delayed-started electronic ballast, which includes an electronic ballast body and a delay switch, wherein the delay switch is arranged at a current input end of the electronic ballast body, is a digital delay switch capable of automatically setting delay time, and includes a temperature sensor for detecting the external environmental temperature of the electronic ballast, an Analogue/Digital (A/D) converter for performing A/D conversion on a signal output by the temperature sensor and a digital processor for performing data processing on data output by the A/D converter; and a processing result value output by the digital processor is connected with a digital input end of the digital delay switch.

After the adoption of the technical scheme of the invention, a delayer with the delay time set by virtue of random numbers corresponding to different environmental temperature is additionally arranged in the ballast, and multiple ballasts connected in parallel in a circuit can be started at different time points after different delay time under the control of the same control switch, which remarkably reduces current impact on the power grid and reduces a voltage drop condition, thereby solving the technical problem that the electronic ballasts are randomly damaged by the instantaneous voltage drop of the power grid caused by the simultaneous starting of the multiple electronic ballasts.

The invention is described below with reference to the drawings and embodiments in detail.

DETAILED DESCRIPTION OF THE PREFERRED EMBODIMENTS

Figure 1:
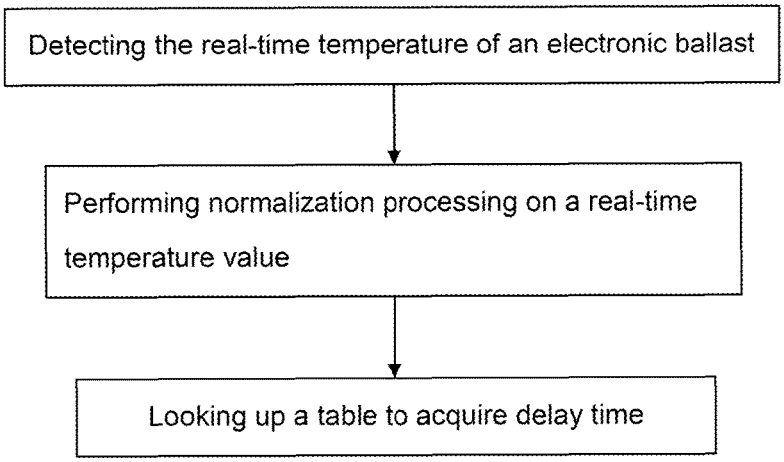
FIG. 1 is a flowchart of acquisition of delay time according to the invention.
Figure 2:
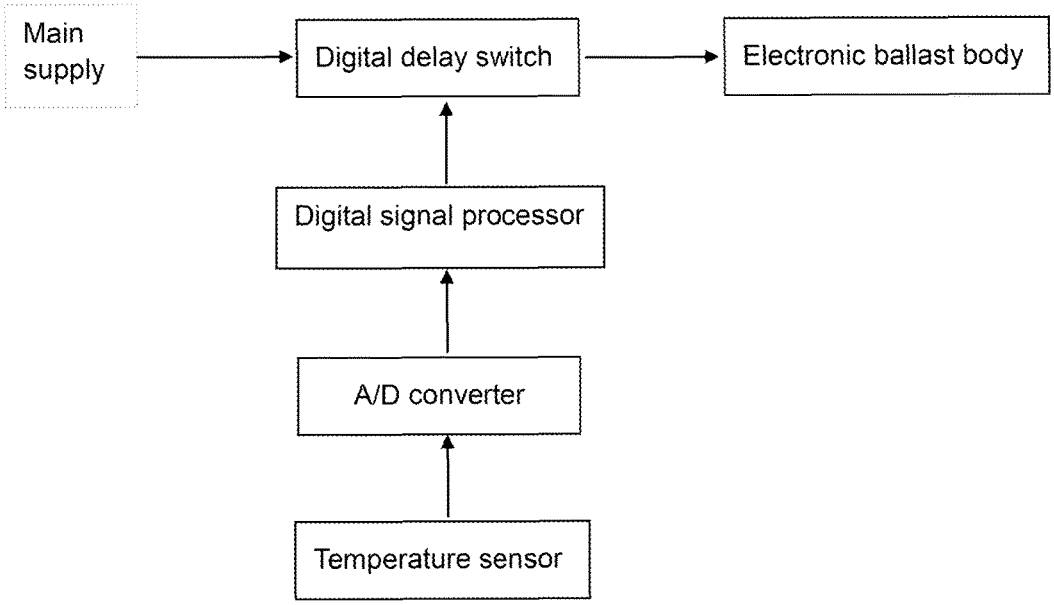
FIG. 2 is a structure diagram of a single delayed-started electronic ballast according to the invention.

Embodiment 1 is an electronic ballast which can be connected in parallel with multiple other electronic ballasts in a circuit for use. A difference between the electronic ballast and an ordinary electronic ballast is that a digital delay switch is added when the electronic ballast is connected to a mains supply, and delay time is acquired by a method of the invention respectively. FIG. 2 shows a single electronic ballast with a delay switch in the embodiment, and as shown in FIG. 2, the delayed-started electronic ballast in the embodiment includes an electronic ballast body and the delay switch, wherein the delay switch is arranged at a mains supply current input end of the electronic ballast body, is a digital delay switch capable of automatically setting the delay time, and includes a temperature sensor for detecting the external environmental temperature of the electronic ballast, an A/D converter for performing A/D conversion on a signal output by the temperature sensor and a digital processor for performing data processing on data output by the A/D converter; and a processing result value output by the digital processor is connected with a digital input end of the digital delay switch. In the processor, random delay time is set, as shown in FIG. 1, by the following steps:

A: detecting the real-time temperature of the electronic ballast;

B: performing normalization processing on a real-time temperature value of the electronic ballast at this moment;

amplifying the real-time temperature value to at least hundreds, and discarding a decimal part;

intercepting a units digit and a tens digit of the amplified real-time temperature value; and dividing a result by 2, and rounding a quotient to obtain a normalized value; and C: acquiring the delay time mapped after the normalization of the real-time temperature value from a predetermined mapping relationship between each value in a normalization interval and the delay time.

In the embodiment, the predetermined mapping relationship between each value in the normalization interval and the delay time is: normalized values 0 to 49 are mapped to the delay time of 0.1 to 5.0 seconds.

In the embodiment, a method for controlling the time sharing starting of electronic ballasts is adopted, and each electronic ballast in the method includes a variable generation part and a program calculation part. The variable generation part includes a temperature detection module and an A/D conversion module. The temperature detection module detects small temperature differences between different electronic ballasts, and obtains different variable coefficients of different electronic ballasts according to the small temperature differences. The A/D conversion module digitally quantifies an analogue part. The program calculation part includes a decimal calculation part and a time setting part. The decimal calculation part is used for amplifying a low-order digit part of quantified data to make a random time difference more obvious and simultaneously limit the condition of great variable coefficient. The time setting part takes a random coefficient as a time reference from energizing to starting, and executes starting work when set time is reached.

As shown in FIG. 2, the delayed-started electronic ballast includes the variable generation part and the program calculation part. The variable generation part includes the temperature detection module and the A/D conversion module. The temperature detection module detects an external environmental temperature signal, and temperature signals at different positions have small differences, and are digitally quantified into digital signals by the A/D conversion module for convenient signal processing. The program calculation part includes the decimal calculation part and a time setting and execution part. A low-order part of the output of the A/D conversion module is intercepted by decimal calculation in a conversion process mainly to amplify a changed part and simultaneously limit a variable value within a certain range. Because change time takes a second as a unit, the variable value can be limited within 50 to realize the stepping of 0.1 second. The time setting and execution part loads the variable value output by the decimal calculation part into a time counter, and different variable values represent different starting time.

Certainly, when the variable value is acquired, the calculation of division by 2 can be eliminated in the abovementioned method, the normalized values are 0-99, and the same result can be obtained by dividing a certain value by 2 or by dividing the sum of the value and 1 by 20.

After the adoption of the technical scheme of the invention, a random time variable generation module is added, and then multiple electronic ballasts can be started at different time points when being simultaneously energized for work, which remarkably reduces the current impact on the power grid and reduces the voltage drop condition, thereby solving the technical problem that the electronic ballasts are randomly damaged by the instantaneous voltage drop of the power grid caused by the simultaneous starting of the multiple electronic ballasts.

What is claimed is:

1. A method for controlling the time sharing starting of electronic ballasts, the electronic ballasts being delayed-started after being energized, wherein acquiring delay time for the delayed starting of the electronic ballasts comprises the following steps: A: detecting a real-time temperature of the electronic ballasts; B: performing normalization processing on real-time temperature values of the electronic ballasts at this moment; and C: acquiring the delay time mapped after the normalization of the real-time temperature values from a predetermined mapping relationship between each value in a normalization interval and the delay time; wherein performing the normalization processing on the real-time temperature in Step B comprises the following steps: B01: amplifying the real-time temperature values; and B02: intercepting low-order digit parts of the amplified real-time temperature values.

2. The method for controlling the time sharing starting of the electronic ballasts according to claim 1, wherein the real-time temperature values are amplified to at least hundreds, and decimal parts are discarded in Step B01; units digits and tens digits of the amplified real-time temperature values are intercepted in Step B02; and the method further comprises a Step B03 of dividing results obtained in Step B02 by 2 and rounding quotients to obtain normalized values.

3. The method for controlling the time sharing starting of the electronic ballasts according to claim 2, wherein the predetermined mapping relationship between each value in the normalization interval and the delay time is: the normalized values 0 to 49 are mapped to the delay time of 0.1 to 5.0 seconds.

* * * * *